US005078117A

United States Patent [19]

Cover

[11] Patent Number: 5,078,117

[45] Date of Patent: Jan. 7, 1992

[54] PROJECTILE PROPELLANT APPARATUS AND METHOD

[76] Inventor: John H. Cover, 5724 N. Camino del Conde, Tucson, Ariz. 85718

[21] Appl. No.: 591,688

[22] Filed: Oct. 2, 1990

[51] Int. Cl.[5] ..... F41B 11/06

[52] U.S. Cl. ..... 124/71; 102/440; 124/56; 124/57; 222/5

[58] Field of Search ..... 102/440; 222/5; 124/56, 124/57, 71

[56] References Cited

U.S. PATENT DOCUMENTS

| | | | |
|---|---|---|---|
| 692,819 | 2/1902 | Bissell | 102/440 |
| 2,028,651 | 1/1936 | Dagnall et al. | 222/5 |
| 2,375,314 | 5/1945 | Mills . | |
| 2,441,011 | 5/1948 | Dodelin | 222/5 |
| 2,660,993 | 12/1953 | Blakeslee . | |
| 2,725,048 | 11/1955 | Koogle . | |
| 2,780,389 | 2/1957 | Sandgren | 222/5 |
| 2,960,031 | 11/1960 | Clift | 102/440 |
| 3,025,845 | 3/1962 | Cardia . | |
| 3,102,525 | 9/1963 | Englis . | |
| 3,177,863 | 4/1965 | Spack . | |
| 3,374,708 | 1/1965 | Wall . | |
| 3,579,964 | 5/1971 | Ohlstein | 222/5 |
| 3,971,292 | 7/1976 | Paniagua . | |
| 4,026,188 | 5/1977 | Woodruff et al. | 89/1.51 |
| 4,126,078 | 11/1978 | Ashley | 102/440 |
| 4,150,656 | 4/1979 | Curran . | |
| 4,204,473 | 5/1980 | Dardick . | |
| 4,601,278 | 7/1986 | Kim | 102/440 |
| 4,691,264 | 9/1987 | Schaffhauser . | |
| 4,846,044 | 7/1989 | Lahr . | |

FOREIGN PATENT DOCUMENTS

| | | | |
|---|---|---|---|
| 2124346 | 2/1984 | United Kingdom | 102/440 |

*Primary Examiner*—Deborah L. Kyle
*Attorney, Agent, or Firm*—Shaffer & Culbertson

[57] ABSTRACT

A projectile propellant device is adapted to supply a compressed gas from a compressed gas container for providing the propulsion force for a projectile or for providing the operating force for a gas powered device. The propellant device includes a gas container containing a volume of gas at sufficient pressure for applying a desired force upon release, and a compressed gas releasing structure for producing a release opening in the compressed gas container in response to the detonation of a pyrotechnic material. The release opening releases the compressed gas for applying the desired force, such as a propulsion force to propel a projectile. The gas releasing structure preferably includes a pyrotechnic charge device and a puncturing device both mounted within a suitable device housing along with the gas container. The pyrotechnic charge is adapted to be detonated preferably through an electrical discharge to force the puncture device into the compressed gas container to puncture or otherwise form the gas release opening to release the gas from the gas container.

19 Claims, 4 Drawing Sheets

PROJECTILE PROPELLANT APPARATUS AND METHOD

BACKGROUND OF THE INVENTION

This invention relates to devices for propelling a projectile, and more particularly, to a small and lightweight device for releasing a compressed gas from a compressed gas capsule to propel a projectile. The invention also encompasses methods for releasing compressed gas from a compressed gas capsule for propelling a projectile.

Numerous devices and mechanisms have been devised for propelling a projectile toward a target. Firearms, for example, use the sudden release of pyrotechnic gasses from a gunpowder or other pyrotechnic charge to propel a bullet. Due to government control and other constraints placed upon firearms, however, other means of providing a projectile propulsion force have been developed. Such non-pyrotechnic devices include devices for releasing compressed gas such as $CO_2$ from a compressed or liquified gas capsule to propel a projectile.

Some compressed gas cartridge weapons are adapted to utilize a single compressed gas cartridge for providing the propellant force for a number of different projectiles. U.S. Pat. No. 4,150,656 to CURRAN discloses such a multishot weapon utilizing compressed gas released from a compressed gas capsule to provide the propellant force. However, multishot compressed gas devices suffer from a number of problems. One problem is that the devices require relatively large and heavy gas metering mechanisms for releasing only the desired quantity of propellant gas for each shot. The multishot compressed gas capsule itself is relatively large and heavy and requires a large housing which increases the overall size of the weapon. Another problem with multishot compressed gas devices is leakage of compressed gas from the gas capsule. The gas capsules are commonly punctured to open a flow of compressed gas to the metering mechanism and pressure is often times lost due to an imperfect seal around the punctured opening. Furthermore, multishot devices generally require a propellant gas, such as $CO_2$, that liquifies at relatively low pressures in order to provide a sufficient number of shots per gas cartridge. Although large volumes of $CO_2$ may be stored in the liquid phase, weapons that use the liquified gas must have a bulky gas expansion chamber to convert the stored liquid into a useable gas propellant. $CO_2$ is also a poor propellant due to its thermodynamic properties.

Other weapons which use compressed gas from a compressed or liquified gas capsule for providing ballistic propulsion force are adapted to expend the compressed material capsule in a single shot. U.S. Pat. No. 2,725,048 to KOOGLE and No. 2,660,993 to BLAKESLEE are each directed to a single shot compressed or liquified gas capsule powered device. Both of these devices used a manually actuated puncturing mechanism to puncture an opening in the compressed material capsule to release the compressed material and fire the weapon. Such manually actuated capsule puncturing mechanisms were large and bulky and again increased the overall size of the weapon. Since the user supplied the capsule puncturing force, the thickness of the capsule walls, and thus the capsule pressure was severely limited. Also, the prior single shot compressed or liquified gas capsule devices provided only a small flow area for releasing gas to propel the projectile and thus made inefficient use of the available energy. Furthermore, the manually operated mechanical puncturing devices operated relatively slowly to release the compressed gas and thus required that the weapon be held on the target for a relatively long period of time.

It is therefore an object of the invention to provide a compressed material capsule ballistic propellant device that overcomes the above-mentioned problems and others associated with prior compressed or liquified gas capsule powered devices. It is also an object of the invention to provide a method for releasing compressed material from a capsule that overcomes the problems associated with prior compressed material releasing methods.

SUMMARY OF THE INVENTION

According to the invention, a projectile propellant device includes a compressed material capsule or container and compressed material releasing means that utilizes the reaction of a pyrotechnic material such as gunpowder or other types of explosives to supply the force required to release the material from the material container. The compressed material may be any suitable gas such as air or hydrogen, or any suitable liquified gas such as $CO_2$, and will hereinafter be referred to as a gas since it generally must reach the gas phase in order to provide the desired propellant force. The device is adapted to be loaded in a suitable weapon or other device which is adapted to use the released gas to propel a projectile toward a target. The pyrotechnic powered gas releasing means eliminates the need for the bulky manually powered capsule puncturing mechanisms of prior devices and enables the propellant device according to the invention to be very small and lightweight and also relatively inexpensive to manufacture. Furthermore, the compressed gas releasing force supplied by the pyrotechnic material is easily capable of providing enough energy to produce large gas release openings in the compressed gas container. The larger gas release openings reduce the gas pressure drop as the gas leaves the container and thus make efficient use of the compressed gas from the container.

The compressed gas releasing means preferably includes gas container puncturing means and a pyrotechnic charge device all contained in a device housing. The compressed or liquified gas container is also mounted or formed in the housing. The preferred container puncturing means includes a puncture member mounted on a base member that is movably mounted within the device housing. The puncture member and the base upon which it is mounted are adapted to be moved by the force of the pyrotechnic reaction so as to force the puncture member through a puncture surface of the gas container. This puncturing provides the gas release opening for releasing the gas to propel a projectile. The compressed gas released from the gas container through the punctured release opening exits the device housing through a propellant outlet and from there may be directed by suitable means to propel a projectile.

The pyrotechnic charge device preferably includes a charge casing for holding a desired amount of pyrotechnic material and ignition means for igniting or detonating the pyrotechnic material. Although the pyrotechnic material may be ignited or detonated by any suitable means, the preferred form of the invention uses an electric discharge through the pyrotechnic material to ignite or detonate the material. In this preferred form of the invention, the charge casing is made of an electrically conductive material and an ignition electrode is positioned through an open end of the charge casing in position to allow an electrical discharge through the pyrotechnic material when an ignition or detonation potential is produced between the charge casing and the electrode.

In one form of the invention, the puncture member is adapted to move to puncture the gas container in response to a reactive force provided by the sudden expansion of pyrotechnic gasses from the pyrotechnic material. In some forms of the invention the pyrotechnic gasses are vented rearwardly or at a right angle to the ballistic axis of the device. In other forms of the invention the pyrotechnic gasses are contained within the device or allowed to slowly leak from the device. Regardless of the manner in which force from the pyrotechnic charge is applied to operate the puncture member or the manner in which the pyrotechnic gasses are handled, the pyrotechnic gasses do not contribute to projectile acceleration.

The release opening to release compressed gas for propelling the projectile need not be formed solely by puncturing the gas container. The pyrotechnic charge means may be adapted to move a valve opening member so as to open a valve or the like on the compressed gas container. Alternatively, where a liquified gas is used the compressed gas container may include a deformable wall that is adapted to be deformed in response to ignition or detonation of the pyrotechnic charge to reduce the volume of the compressed gas container and thereby increase the pressure within the container to rupture a rupture plug to provide the gas release opening. Where a puncture member is used to puncture the gas container, the puncture member may include opening enhancement means for producing a larger gas release opening.

In operation, and according to the method of the invention, the pyrotechnic charge is first ignited or detonated by suitable means. The method includes applying at least a portion of the force from the pyrotechnic charge ignition or detonation to the compressed or liquified gas container so as to form a suitable gas release opening in the container for releasing the propellant gas therefrom. The method next includes directing the gas from the gas container through the release opening to provide a projectile propelling force.

In one preferred operation of the invention, the step of igniting the pyrotechnic charge includes directing a high voltage electrical discharge through the pyrotechnic material in the charge casing. The voltage may be produced using a piezoelectric crystal or any other suitable means. Also, the igniting or detonating step may be performed using an electrically resistive filament or a percussion device as an alternative to the high voltage discharge method.

The force from the pyrotechnic charge is preferably applied to puncture the compressed or liquified gas container to form the release opening, or alternatively, to operate a release valve on the container or to rupture a rupturable plug on the container. The method of the invention may also include venting the pyrotechnic gasses released from the ignition or detonation of the pyrotechnic charge.

These and other objects, advantages, and features of the invention will be apparent from the following description of the preferred embodiments, considered along with the accompanying drawings.

DESCRIPTION OF THE PREFERRED EMBODIMENTS

Figure 4:
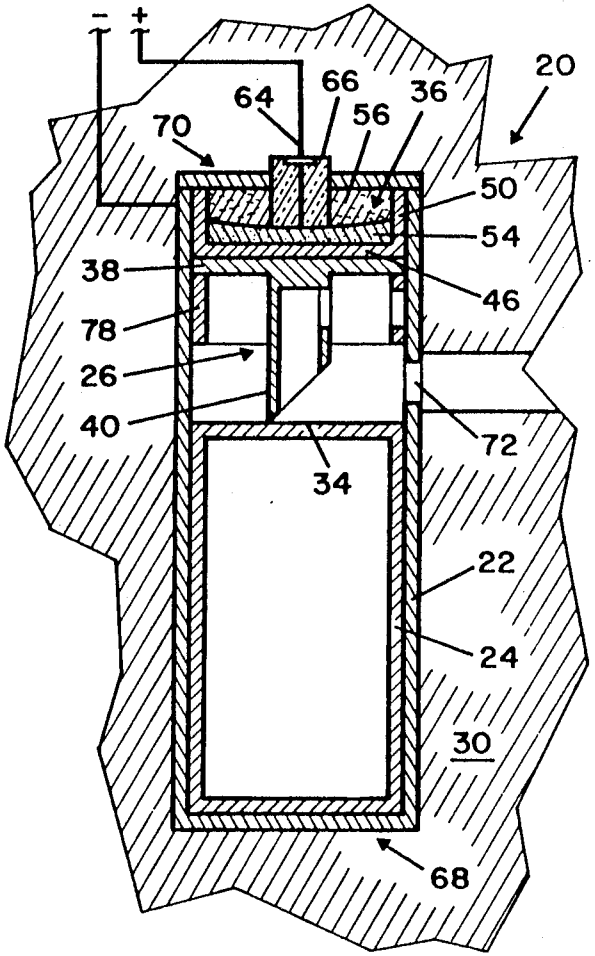
FIG. 4 is a view in section similar to FIG. 2 but with the projectile propellant device loaded in a weapon in position to supply compressed gas for propelling a projectile from the weapon.
Figure 2:
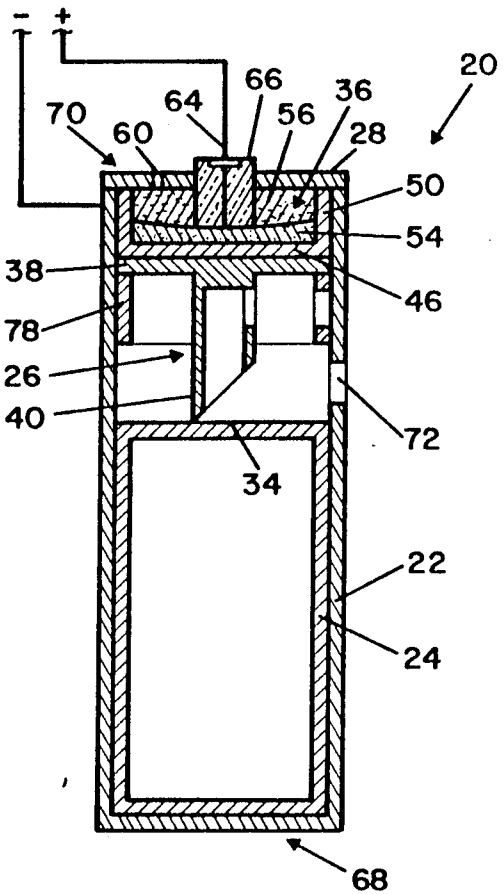
FIG. 2 is a greatly enlarged view in longitudinal section taken along line 2—2 of FIG. 1.
Figure 1:
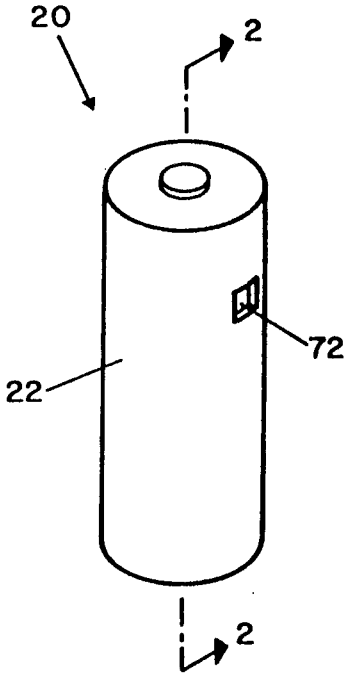
FIG. 1 is a somewhat enlarged view in perspective of a projectile propellant device embodying the principles of the invention.
Figure 3:
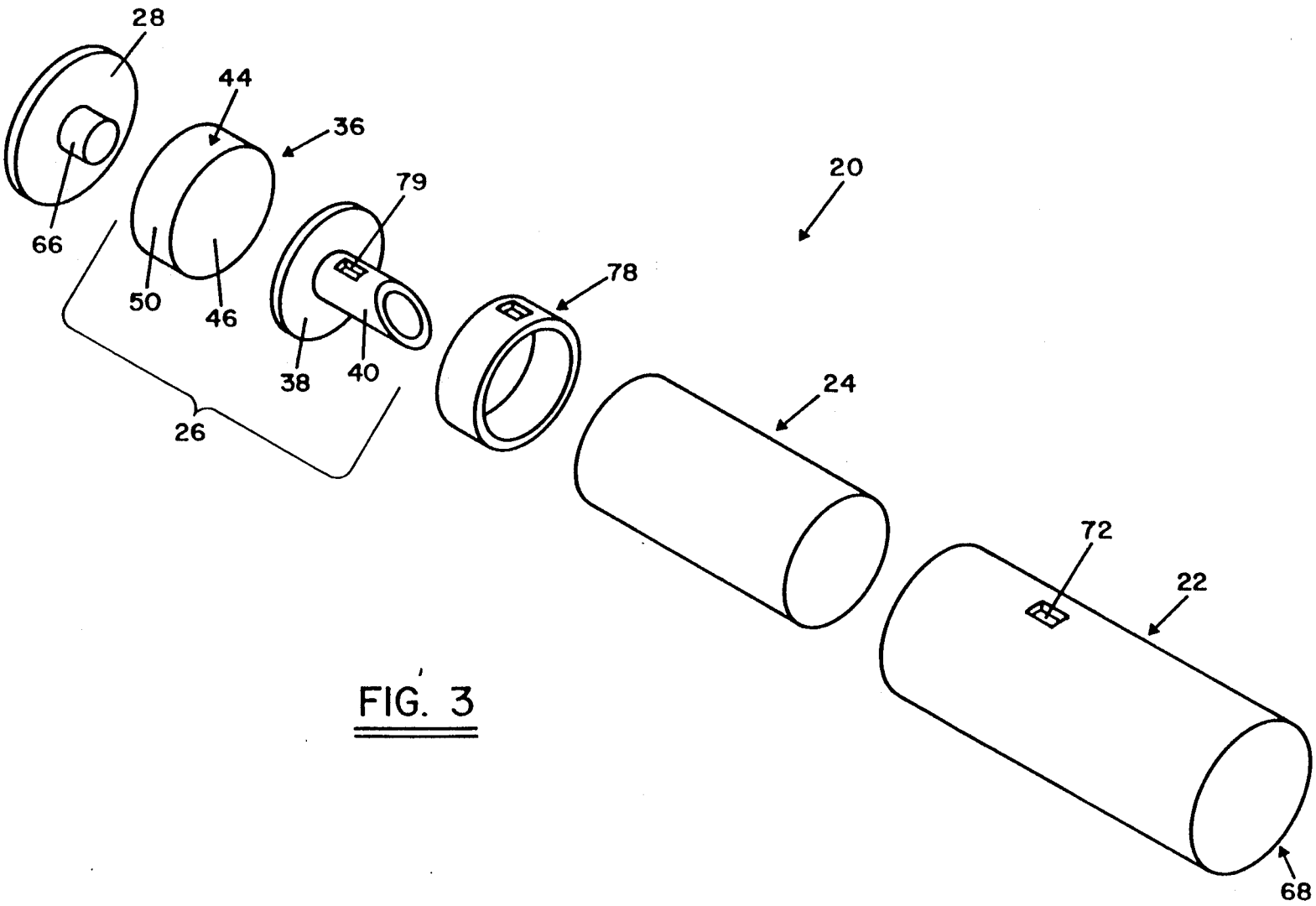
FIG. 3 is an enlarged and exploded view in perspective of the device shown in FIGS. 1 and 2.
Figure 5:
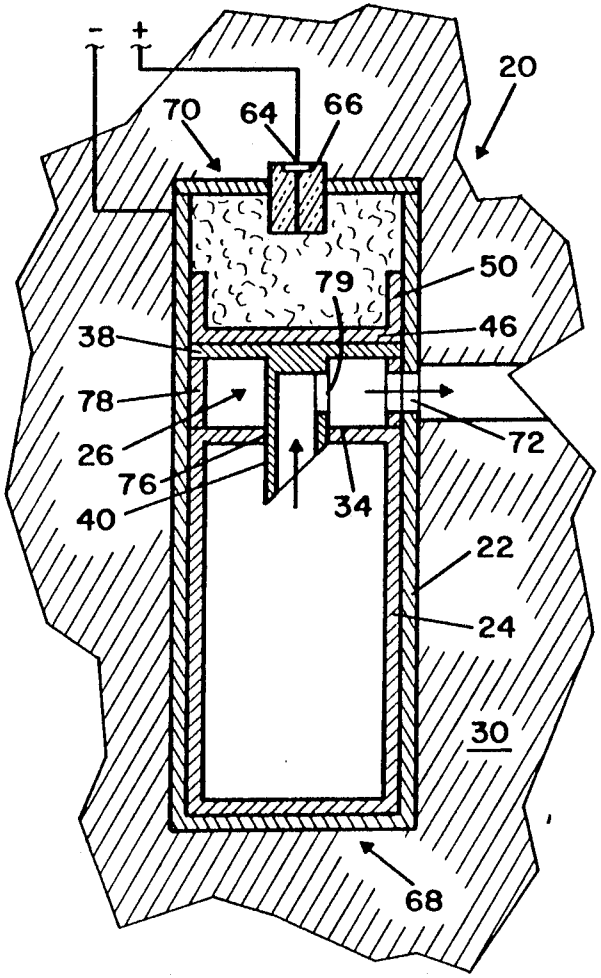
FIGS. 5 is a view in section similar to FIG. 4 but showing the puncture member extended to provide compressed gas for propelling a projectile.

Referring particularly to FIGS. 1-3, a projectile propellant device 20 embodying the principles of the invention includes a device housing 22 housing a compressed or liquified gas container 24 and gas releasing means generally indicated at reference numeral 26 (FIGS. 2 and 3). As shown in FIGS. 4 and 5, the device 20 is adapted to be loaded in a weapon 30 or other apparatus for supplying compressed gas to operate the particular apparatus. In the case of the weapon 30 or similar compressed gas powered apparatus, the gas from the device 20 is used to propel a projectile (not shown) toward a target.

Referring particularly to FIGS. 2 and 3, the gas container 24 is separately formed from a suitable material such as steel and then mounted in the device housing 22. The gas releasing means 26 and gas container 24 are both retained in place in the housing 22 by connecting a housing end plate 28 over the open end of the housing. In other forms of the invention, however, the gas container may be formed integrally with the device housing 22 prior to inserting the gas releasing means 26 and connecting the end plate 28. In either case, the gas container 24 includes a puncture surface 34 (FIG. 2) adapted to be opened or punctured by the gas releasing means 26.

In the form of the invention illustrated in FIGS. 1, the gas releasing means 26 includes pyrotechnic charge means generally indicated at reference numeral 36 and puncture means in this case comprising a base member 38 and a puncture member 40. The puncture member 40 is mounted on the base member 38 and the base member is movably, in this case, slidably mounted within the device housing 22. When sufficient force is supplied to the base member 38 by the pyrotechnic charge means 36, the base member and the puncture member 40 mounted thereon are adapted to move toward the gas container puncture surface 34 so that the puncture member contacts and punctures an opening in the puncture surface. While the slidable base member 38 and puncture member 40 is currently preferred, the base member may alternatively comprise a deformable plate adapted to be deformed by the force from the pyrotechnic charge means so as to move a puncture member mounted thereon toward the gas container puncture surface and produce the desire gas release opening.

Referring particularly to FIGS. 2 and 3, the preferred pyrotechnic charge means 36 includes a charge casing 44 movably, or in this case, slidably mounted within the device housing 22. The charge casing 44 includes a closed charge end 46 opposite an open end, and side portions 50 connected to the closed charge end to form a charge containment area. As shown in FIG. 2, a charge of pyrotechnic material 54 is positioned adjacent to the closed end 46 of the charge casing 44. An electrical insulating material 56 is positioned over the charge material 54 in the charge casing 44 to cover the charge material and the open end of the charge casing. The charge material 54 is adapted to be ignited or detonated to release a sufficient amount of energy to force the base member 38 and puncture member 40 toward the puncture surface 34 to provide the desired gas release opening.

The force supplied by the pyrotechnic charge means 36 is produced by the sudden expansion of pyrotechnic gasses from the reacting pyrotechnic material 54 which forces the charge casing 44 and the adjacent base member 38 toward the gas container puncture surface 34. In the illustrated form of the invention, the pyrotechnic gasses are contained in the device housing 22 to supply the desired puncturing or gas container opening force. Alternatively, the pyrotechnic gasses may be released through a suitable vent opening 60 (shown in phantom in FIG. 2) in the device housing. In any event, the pyrotechnic gasses produced according to the invention are not used to propel a projectile directly, but to drive the desired gas container puncturing device.

In the illustrated preferred form of the invention, the charge material 54 of the pyrotechnic charge means 36 is electrically ignited or detonated to produce the desired gas container opening force. The preferred charge ignition or detonation means includes an electrode 64 extending through the insulating material 56 to a position generally adjacent to the pyrotechnic material 54 and generally in the center of the charge casing 44. Also, the charge casing 44 is made of an electrically conductive material and its closed end 46 forms an opposite electrode spaced from the electrode 64 by the pyrotechnic material 54. Electrode 64 is connected to a voltage source capable of applying a high electrical potential across the charge casing 44 and the electrode 64 to produce an electrical discharge through the pyrotechnic material 54. The pyrotechnic material 54 is selected such that the electrical discharge ignites or detonates the material to release the desired gas container opening force. For example, in the electrically detonated form of the invention, the pyrotechnic charge 54 may comprise lead styphnate-azide which is susceptible to detonation in response to an electric spark discharge.

In the preferred form of the invention illustrated in FIGS. 1–5, the device housing 22 is made of an electrically conductive material and is generally cylindrical in shape with a gas container end generally indicated at reference numeral 68 and a vent end 70 in which the puncture means and pyrotechnic charge means are mounted. The device housing 22 also includes a gas or propellant outlet 72 through which gas released from the gas container 24 may be directed or transferred to the particular apparatus in which the device 20 is used. The propellant opening 72 is preferably formed near the mid-section of the elongated housing 22.

The operation of the projectile propellant device 20 and the method of the invention may be described with particular reference to FIGS. 4 and 5 which each show the projectile propellant device 20 mounted or loaded in position in the weapon 30 or other apparatus requiring the release of compressed gas. The apparatus 30 may be any device that requires the sudden release of compressed gas for operation such as a gas powered rifle or pistol or any other projectile launching device such as a device for launching an electrified net from an electric stun gun. In the stun gun net launching application, for example, the device 20 is mounted with the device housing longitudinal axis perpendicular or transverse to the ballistic axis of the launching device. This transverse orientation shortens the apparatus 30 and enables the apparatus to be fairly compact and even pocket-sized.

In FIG. 4, the device 20 is in a loaded and unactivated position in the weapon 30. As indicated in FIG. 5, the method of the invention comprises detonating the pyrotechnic charge 54 and then applying at least a portion of the force released from such detonation to form a release opening 76 in the compressed gas container 24. The gas from the gas container is then directed through the release opening 76 and out of the device 20 through the opening 72 to provide a projectile propelling force.

In the form of the invention shown in FIG. 5, the step of detonating the pyrotechnic charge 54 is performed by applying a high voltage to the electrode 64 to produce a discharge across the gap between the electrode 64 and the end 46 of the charge casing 44. In the stun gun electrified net launching application, the voltage may be provided conveniently from the power source used to produce the stun voltage. Alternatively, a piezoelectric device may be used to produce the desired high voltage. Also, those skilled in the art will readily recognize numerous other methods of detonating or igniting the pyrotechnic charge, including methods that do not rely on an electric discharge or resistance heating.

As shown in FIG. 5 the step of applying the force from the pyrotechnic detonation to the gas container 24 is performed with the puncture member 40. The rapidly expanding gasses produced by the detonation force the base member 38 downwardly along with the puncture member 40 mounted on the base member, until the downward motion is stopped by a stop ring 78. At this point the end of the hollow puncture member 40 extends through the container puncture surface 34 to produce the large release opening 76 and a side opening 79 in the puncture member is generally aligned with the opening 72 in the device housing 22. Thus the gas from the container 24 is free to expand rapidly through the opening 72 for use in propelling the desired projectile.

In the device shown in FIG. 5, the pyrotechnic gasses produced upon detonation of the charge 54 are contained within the device housing 22. The electrode 64 in this case is contained in an electrode insulating material 66 that is rigidly connected to the housing 22 so as to withstand the pressure produced by the pyrotechnic gasses. Such an insulated electrode is marketed under the name CERAMICON. Although the gasses produced by the detonation exert a very high pressure initially, the gases may cool rapidly to leave a relatively small residual pressure in the device housing 22. Alternatively, the pyrotechnic gasses may be vented away from the breech of the particular weapon 30 by a small vent opening such as the opening 60 (FIG. 2) that may be formed in the end of the housing 22 containing the pyrotechnic charge.

Figure 6:
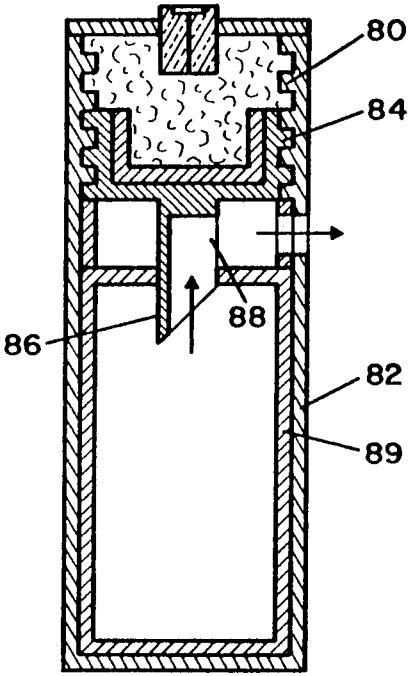
FIG. 6 is a somewhat diagrammatic view in section showing an alternate puncture member according to the invention.

FIG. 6 shows an alternate puncturing arrangement that is adapted to produce an enhanced gas release opening in the gas container 24. This form of the invention includes a female threaded section 80 formed in the device housing 82. Rather than the slidable base member 38 shown in FIGS. 1-5, the embodiment in FIG. 6 includes a male threaded plug 84 received in the female threaded section 80. The hollow puncture member 86 is connected to the plug 84 and includes a side opening 88 that extends up the short side of its angled end.

In this form of the invention the corresponding threads of the plug 84 and female threaded section 80 cause the puncture member 86 to rotate approximately 90° as the angled end of the puncture member pierces the gas container 89. This rotation of the puncture member 86 turns its end opening away from the displaced gas container material to provide a larger effective opening through which gas may escape from the gas container 89.

Figure 7:
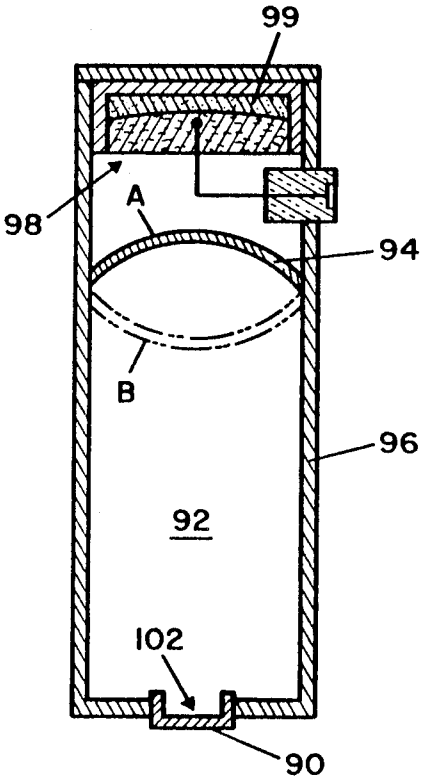
FIG. 7 is an enlarged view in section of an alternate form of the invention in which the compressed gas is released from the compressed gas container by rupturing a portion of the container.

FIG. 7 illustrates an alternate form of the invention in which the gas releasing means includes a rupturable plug 90 in an alternate liquified gas container 92 and a deformable plate 94 which forms one end of the gas container. In this form of the invention, the gas container 92 is integrally formed within a device housing 96 and contains a liquified gas. The pyrotechnic charge means 98 in the form of the invention illustrated in FIG. 7 is similar to the pyrotechnic charge means shown in FIG. 2, but is fixed in the housing 96 with its open end positioned to direct the rapidly expanding pyrotechnic gasses into the device housing 96 toward the deformable plate 94.

Upon ignition or detonation of pyrotechnic material 99 in the pyrotechnic charge means 98, the rapidly expanding pyrotechnic gasses deform the deformable plate 94 from the position shown at "A" to the position shown at "B", thereby decreasing the volume of the gas container 92. The deformation of the deformable plate 94 from position "A" to position "B" causes the plug 90 which is made of a softer material than the device housing 96 to rupture to form a material release opening. The released material may be used to propel a separate projectile, or may be used as the projectile itself. The deformable plate 94 contains the pyrotechnic gasses and prevents the gasses from passing through the gas container 92 through the ruptured plug 90. As in the embodiment shown in FIGS. 1-5, suitable vent means (not shown) may be formed in the device housing 96 for slowly venting the pyrotechnic gasses after being used to move the deformable plate 94 from position "A" to position "B".

In the form of the invention illustrated in FIG. 7, the deformable plate 94 may be a relatively soft and malleable metal such as brass, silicon bronze, or phosphor bronze brazed or otherwise suitably connected within the device housing 96 to form an end wall of the gas container 92. The rupture plug 90 is preferably formed from a soft material such as brass or bronze, brazed or otherwise connected over a plug opening 102 formed in another surface of the gas container 92.

Figure 8:
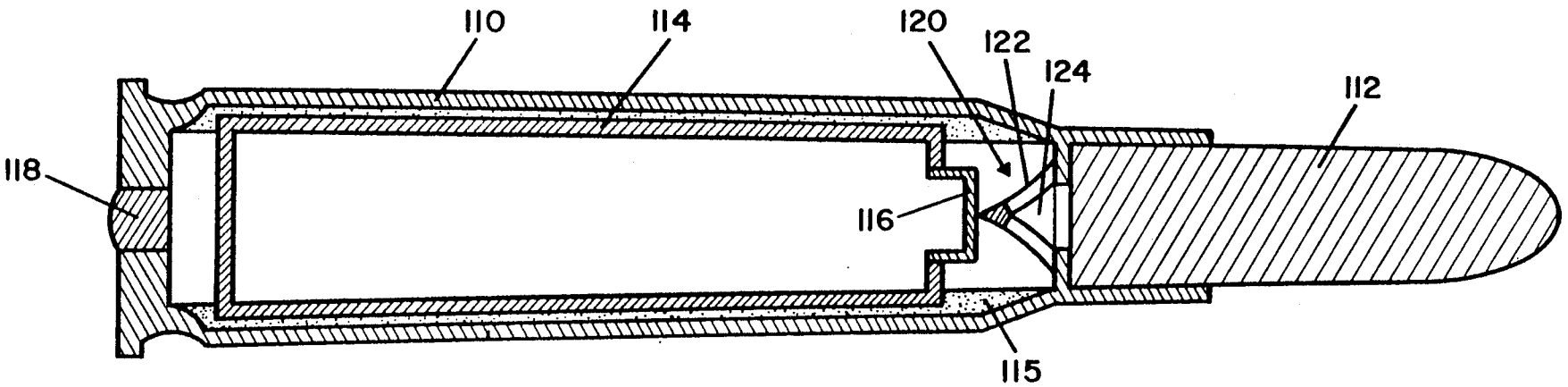
FIG. 8 is a somewhat diagrammatic view in longitudinal section of an alternate form of the invention adapted to be used in a conventional percussion rifle or pistol.

FIG. 8 shows another alternate form of the invention. This form of the invention is adapted for use in conventional rifles or pistols and includes a housing 110 having the shape of a standard firearm shell with a standard caliber bullet 112 mounted in an open end. A compressed gas container 114 is slidably mounted within the housing 110 and has a puncture surface 116 positioned at the end of the gas container nearest the bullet 112. A compressible seal 115 is positioned between the housing 110 and the gas container 114.

The gas releasing means in this form of the invention includes a standard percussion primer 118 mounted in the housing 110 at the end opposite to the bullet 112, and a puncture member 120. The puncture member 120 comprises generally a tetrahedron with four cutting edges 122 separated by open spaces 124.

In operation, the device shown in FIG. 8 is loaded into the breech of a standard firearm adapted for use with center fire cartridges. The pyrotechnic material in the percussion primer 118 is detonated as the primer cap is struck by the firing pin as in a standard firearm cartridge. However, rather than detonating the gunpowder that would be present in a standard cartridge, the force from the primer detonation forces the gas container 114 toward the bullet end of the housing 110. This movement forces the puncture member 120 through the puncture surface 116 to form a gas release opening through which the compressed gas may escape to propel the bullet 112. The compressible seal 115 enables the gas container 114 to slide toward the bullet end of the housing 110 while preventing the pyrotechnic gasses released from the primer from passing the gas container.

Although the form of the invention shown in FIG. 8 uses a center fire cartridge, the invention may also be incorporated in rim fire cartridges. Also, the percussion primers may be replaced with pyrotechnic charges detonated by electrical discharge or electrically generated heat for use in non-standard weapons.

In all of the illustrated embodiments the gas employed in the compressed gas containers may be any suitable propellant gas. For example, compressed air provides good ballistic performance at low cost. Alternatively, compressed hydrogen may be used for enhanced ballistic performance.

The above described preferred embodiments are intended to illustrate the principles of the invention, but not to limit the scope of the invention. Various other embodiments and modifications to these preferred embodiments may be made by those skilled in the art without departing from the scope of the following claims. For example, numerous alternative arrangements may be used to produce the gas release opening in the gas container under the force supplied by the pyrotechnic charge. Rather than puncturing a surface of the container, the force from the pyrotechnic charge may be employed to open a suitable valve on the gas container or to break a brittle material formed over a container opening. Also, various alternative puncturing arrangements may be employed. In one alternate form the puncture member may be mounted on a deformable container wall inside the gas container and adapted to puncture an opposite wall of the container as the deformable wall is deformed by the pyrotechnic detonation.

I claim:

1. A projectile propellant device comprising:

(a) projectile housing means for housing a projectile in position to be propelled from the housing;

(b) a container secured to the housing means and containing a volume of gas compressed to a sufficient pressure for immediately propelling the projectile from the housing means upon release of the gas through a gas release opening in the container;

(c) compressed gas releasing means for producing the gas release opening in the container in response to the chemical reaction of a pyrotechnic material; and (d) gas directing means extending between the container and the projectile for directing the gas released from the container through the gas release opening to the projectile so that the gas, upon release from the container, immediately propels the projectile from the projectile housing.

2. The projectile propellant device of claim 1 wherein the compressed gas releasing means includes:

(a) puncture means for puncturing the container to provide the release opening when driven with a puncturing force; and (b) pyrotechnic charge means for providing the puncturing force for the puncture means.

3. The projectile propellant device of claim 2 wherein the container, the puncture means, and the pyrotechnic charge means are each positioned within a device housing.

4. The projectile propellant device of claim 3 wherein the puncture means includes:

(a) a base member mounted within the device housing in an unactivated position and adapted to be moved toward a puncture surface on the container to a puncture position; and (b) a puncture member mounted on the base member for contacting and puncturing the container puncture surface to provide the release opening as the base member is moved from the inactivated position to the puncture position.

5. The projectile propellant device of claim 4 wherein the puncture member comprises an elongated hollow cylinder having a side opening near the end connected to the base member and an open angled end adapted to contact and puncture the puncture surface.

6. The projectile propellant device of claim 4 wherein:

(a) the puncture member comprises an elongated hollow cylinder having a side opening extending along one side and an open angled end adapted to contact and puncture the puncture surface; and (b) the base member is mounted within the device housing on rotating means for rotating the puncture member about its longitudinal axis as it punctures the puncture surface.

7. The projectile propellant device of claim 4 wherein the pyrotechnic charge means includes:

(a) a charge casing having an opening at one end;

(b) a charge of pyrotechnic material positioned within the charge casing at an end generally opposite the open end; and (c) detonation means for detonating the charge of pyrotechnic material.

8. The projectile propellant device of claim 7 wherein:

(a) the container is positioned at a container end of the device housing;

(b) the charge casing is positioned within the device housing in an end opposite the container end and adjacent to the base member so that upon detonation of the pyrotechnic material, the base member is forced toward the puncture surface of the container; and (c) the device housing includes a propellant outlet at a middle section thereof through which the compressed material released through the release opening may exit the housing.

9. The projectile propellant device of claim 8 wherein:

(a) the charge casing and the device housing are formed from electrically conductive material and are in electrical communication with each other; and (b) the detonation means includes an electrode extending through the open end of the charge casing in position for directing a high voltage discharge through the pyrotechnic material to detonate said material when a detonation potential is introduced between the charge casing and the electrode.

10. The projectile propellant device of claim 9 wherein the device housing includes pressure venting means for venting the pyrotechnic gasses from the device housing.

11. The projectile propellant device of claim 1 wherein the container includes:

(a) a rupture surface adapted to rupture when a release pressure is applied thereto; and (b) a deformable plate adapted to be deformed to decrease the volume of the container so as to raise the pressure of the material contained therein to the release pressure.

12. The projectile propellant device of claim 11 wherein the compressed gas releasing means includes pyrotechnic charge means adapted for detonating to release pyrotechnic gasses within a device housing to deform the deformable plate.

13. A projectile propellant device comprising:

(a) an elongated device housing having a first end and bullet end;

(b) a projecitle mounted in the bullet end of the device housing;

(c) a compressed gas container containing a sufficient volume of propellant gas at a pressure required for immediately propelling the projectile from the device housing upon release of the gas from the container through a gas release opening, the compressed gas container being mounted in the device housing;

(d) pyrotechnic charge means positioned at the first end of the device housing for forcing the compressed gas container toward the bullet end of the housing upon detonation; and (e) puncture means for producing the gas release opening in the compressed gas container as the container is forced toward the bullet end of the housing by the pyrotechnic charge means, the gas release opening enabling the compressed gas to flow into the device housing between the compressed gas container and the projectile to immediately propel the projectile from its position at the bullet end of the housing.

14. The device of claim 13 wherein the puncture means comprises:

(a) a puncture member adapted to puncture the gas release opening in the container as the container is driven toward the bullet end of the housing upon detonation of the pyrotechnic charge means.

15. The device of claim 14 wherein:

(a) the housing has a shape similar to a standard firearm cartridge;

(b) the projectile is a standard caliber bullet for the particular cartridge; and (c) the pyrotechnic charge means is adapted to be detonated by a firearm percussion firing mechanism.

16. A method of providing compressed gas for propelling a projectile, the method comprising the steps of:

(a) detonating a pyrotechnic charge;

(b) applying at least a portion of the force from the detonation of the pyrotechnic charge to a container containing a volume of gas compressed sufficiently to immediately propel the projectile upon release of the gas through a gas release opening in the container;

(c) forming the gas release opening in the container with the force applied to the container from the detonation of the pyrotechnic charge; and (d) directing the gas from the gas release opening in the container to the projectile to immediately propel the projectile.

17. The method of claim 16 wherein the step of detonating the pyrotechnic charge includes directing a high voltage electrical discharge through a pyrotechnic material.

18. The method of claim 16 wherein the step of applying force from the pyrotechnic charge detonation to the container includes applying at least a portion of the force from the pyrotechnic detonation to force a puncture member through a puncture surface of the container so as to form the release opening in the container.

19. The method of claim 18 including the step of venting the pyrotechnic gasses from the detonation of the pyrotechnic charge.

* * * * *